US006664937B2

(12) United States Patent
Vermette et al.

(10) Patent No.: US 6,664,937 B2
(45) Date of Patent: Dec. 16, 2003

(54) TWO-AXIS POLE MOUNT ASSEMBLY

(76) Inventors: Louis R. Vermette, 8305 Rimbaud Brossard, Quebec (CA), J4X 1T4; Kenneth E. Clayton, 131 de la Verendrye, Chateauguay, Quebec (CA), J6K 4Z3

( * ) Notice: Subject to any disclaimer, the term of this patent is extended or adjusted under 35 U.S.C. 154(b) by 0 days.

(21) Appl. No.: 10/167,590

(22) Filed: Jun. 13, 2002

(65) Prior Publication Data

US 2002/0196195 A1 Dec. 26, 2002

Related U.S. Application Data

(60) Provisional application No. 60/297,452, filed on Jun. 13, 2001.

(51) Int. Cl.[7] ..... H01Q 1/12
(52) U.S. Cl. ..... 343/892; 343/882; 248/278.1
(58) Field of Search ..... 343/878, 880, 343/882, 891, 892, 757, 765; 248/276.1, 278.1, 279.1

(56) References Cited

U.S. PATENT DOCUMENTS 5,963,179 A * 10/1999 Chavez ..... 343/892
6,045,103 A * 4/2000 Costa et al. ..... 248/278.1
6,264,152 B1 * 7/2001 Bloch et al. ..... 343/882
6,484,987 B2 * 11/2002 Weaver ..... 343/892

* cited by examiner

*Primary Examiner*—Hoang Nguyen
(74) *Attorney, Agent, or Firm*—Duane Morris LLP

(57) ABSTRACT

A mounting assembly for attaching a radio or antenna to a support includes a base having a contact member, and a first adjustment component pivotally mounted to the base for pivoting about a first adjustment component pivot axis. The first adjustment component has at least two adjustment members located on opposite sides of the pivot axis which contact the contact member when the first adjustment component is in a locked position.

31 Claims, 6 Drawing Sheets

TWO-AXIS POLE MOUNT ASSEMBLY

RELATED APPLICATIONS

This application claims the priority of U.S. provisional patent application Serial No. 60/297,452 entitled "Two-Axis Pole Mounting Assembly" filed Jun. 13, 2001.

BACKGROUND OF THE INVENTION

The present invention relates to telecommunications systems and more particularly to a mounting assembly for mounting a telecommunications radio to a support.

Mounting assemblies for mounting radios or antennas to outdoor support structures such as poles are well known in the telecommunications industry. The mounting assemblies generally include means for adjusting the radio or antenna both in elevation and azimuth in order to properly align the radio or antenna. Typically these assemblies contain a single component upon which both the elevational and azimuthal adjustments are made. As both axes are adjusted at the same pivoting point, they are not independent of each other. This is disadvantageous in that adjustment of one axis will interfere with the adjustment of the other axis. This requires the technician to repeatedly retune the adjustments.

Another problem with current mount assemblies is that they do not provide for a solid locking geometry. Rather, once the axial adjustments have been made, there is still some looseness in the joints of the mount assembly, which results in a need for frequent readjustment.

An improved mount assembly is needed.

DESCRIPTION OF PREFERRED EMBODIMENTS

U.S. Provisional Patent Application No. 60/297,452, filed Jun. 13, 2001 is incorporated by reference herein in its entirety.

Figure 1:
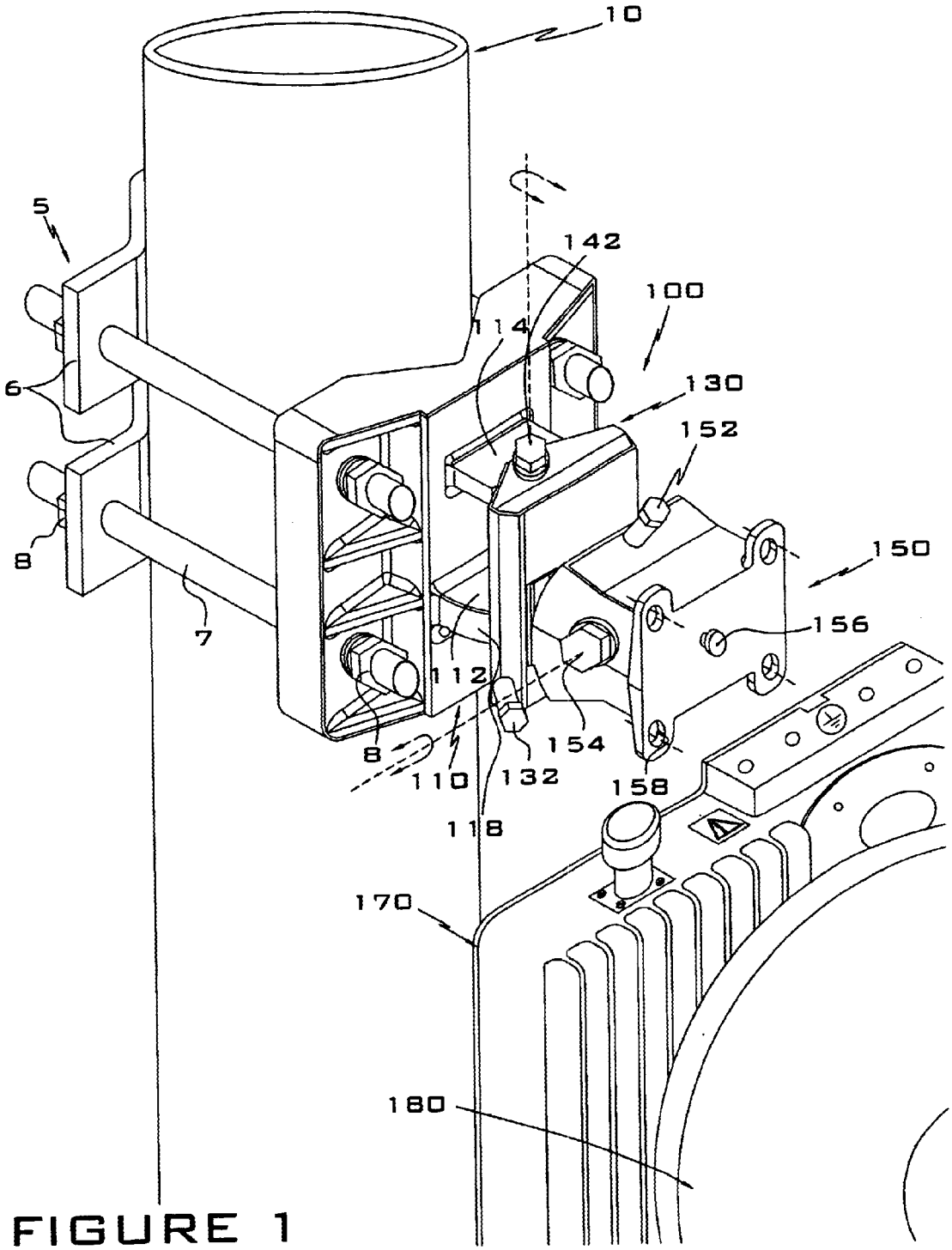
FIG. 1 is a pictorial representation of the radio mounting assembly mounted to a pole, according to one embodiment of the present invention.
Figure 2:
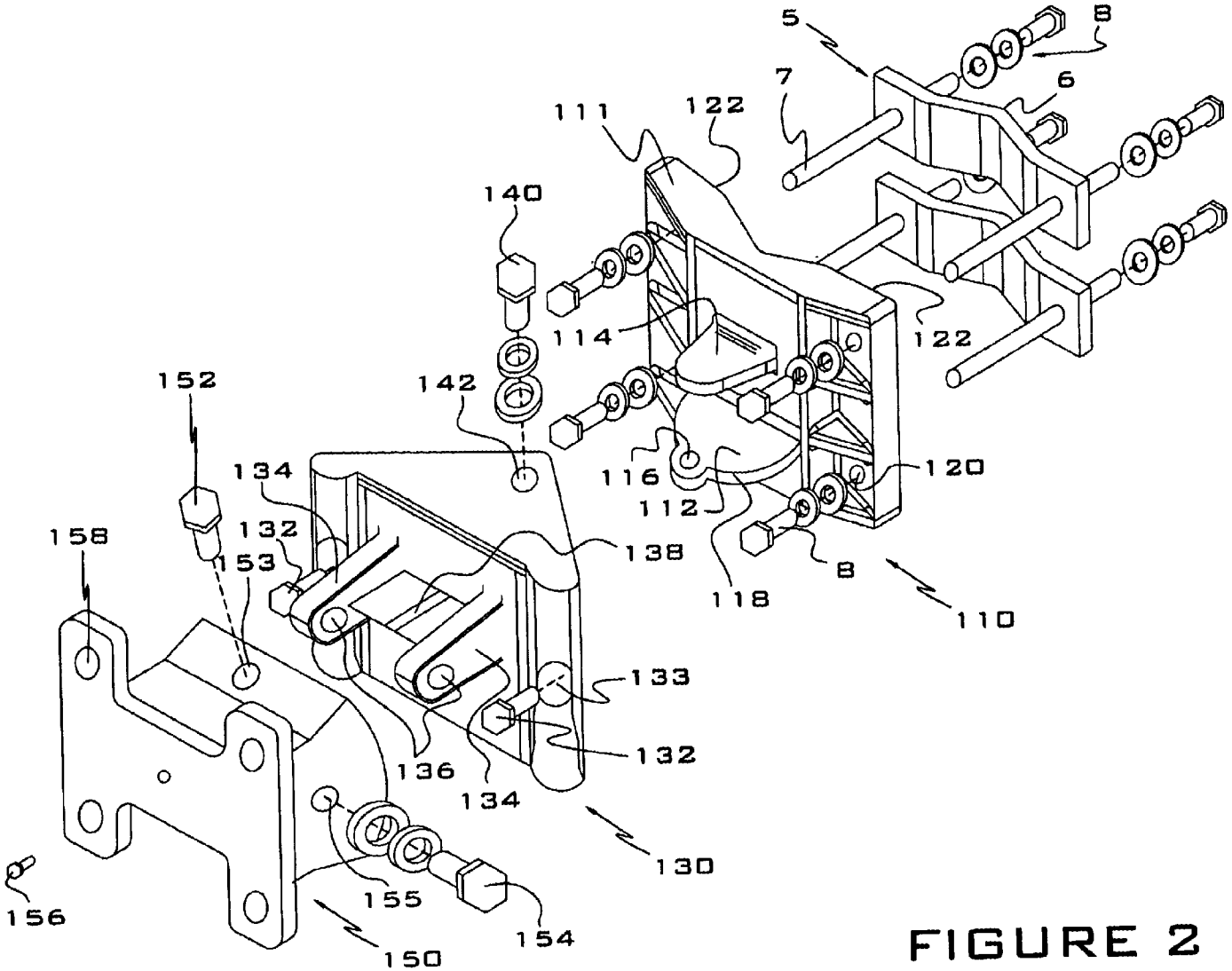
FIG. 2 is an exploded pictorial view of the mounting assembly and bracing system from the front thereof.

Referring to FIGS. 1 and 2, a radio mounting assembly 100 is shown mounted to a pole 10. The mounting assembly 100 is braced to the pole 10 via bracing system 5 which includes braces 6, brace fasteners (e.g. bolts) 7 and nuts 8. Although shown attached to a pole 10, it should be understood that the mounting assembly 100 described herein may be coupled to any number of support structures. As illustrated, a base 110 has planar surfaces 122 and mounting holes 120 that allow it to be attached to any substantially planar surface, such as a wall, roof or the like. Additionally, or alternatively, base 110 may include various mounting holes, clips, ridges or the like in order to easily attach to a number of structures, such as walls, roofs, or the like. Moreover, various adaptations or configurations of base 110 may be provided for coupling to a support structure depending on the particular support structure to be associated therewith. For example, instead of a planar surface 122, any contour may be used to accommodate the shape of a surface to which the base 110 is mounted.

Mounting assembly 100 comprises base 110, an azimuthal (horizontal) adjustment component 130 and an elevational (vertical) adjustment component 150. According to one exemplary embodiment (as shown in FIGS. 1 and 2), the azimuthal adjustment component 130 is directly attached to the base 110 and the elevational adjustment component 150 is directly attached to the azimuthal adjustment component 130. Alternatively, the elevational adjustment component 150 could be directly attached to the base 110 and the azimuthal adjustment component 130 directly attached to the elevational adjustment component 150.

Exemplary base 110 comprises a support base 111, adjustment component supports 112 and 114, pivot holes 116 providing a pivot axis, a contact plate 118, mounting holes 120 and rear surfaces 122. Support base 111 and mounting holes 120 provide for attachment to a variety of support structures as described above. Adjustment supports 112 and 114 and pivot holes 116 allow for attachment of a first adjustment component. In this example, the first adjustment component is the azimuthal adjustment component 130 and a second adjustment component (attached to the first adjustment component) is the elevational adjustment component 150. Mounting holes 120 allow for attachment of the mounting assembly 100 to a variety of support structures as set forth above.

Figure 3:
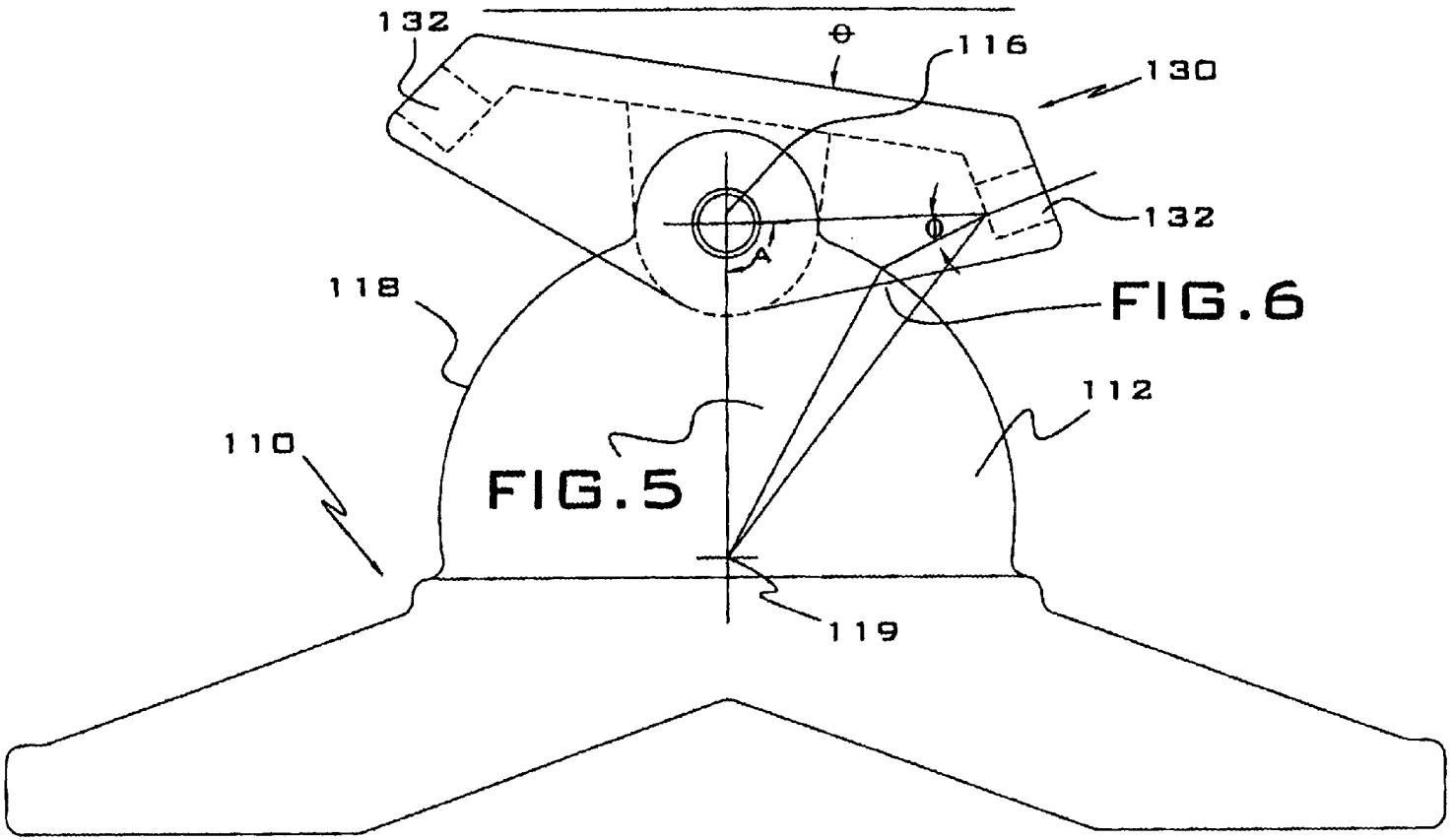
FIG. 3 is a pictorial representation of the base and azimuthal adjustment component of the mounting assembly including the triangles from which the screw extension length can be determined.

The contact plate 118 of the base 110, shown in the figures as a semi-circular protrusion of the adjustment component support 112, has a center point 119 which is eccentrically located from the pivot axis (see FIG. 3) in holes 116. Although shown as an extension of adjustment component support 112, the contact plate 118 may be located at a variety of locations on the base 110 including locations separate from adjustment component supports 112 or 114.

Further, although preferred embodiments of the contact plate 118 include a circular profile, other profiles may be substituted on the contact plate. For example, the contact plate may have an elliptical, paralobolic, hyperbolic or flat profile. Also, a ridge or frame may be employed rather than a solid plate.

The exemplary azimuthal adjustment component 130 includes two adjustment members, which may be, for example, screws or bolts 132, two adjustment holes 133, adjustment component supports 134, first pivot holes 136 providing a pivot axis for the elevational adjustment component 150, a contact plate 138, at least one pivot member (e.g., screws or pins) 140 and second pivot holes 142 providing a pivot axis for adjustment of the azimuthal adjustment component 130. The azimuthal adjustment component 130 is pivotally coupled to the base 110 by the at least one pivot pin or screw 140. The pivot screws (or screw) 140 are inserted through the respective second pivot holes 142 of the azimuthal adjustment component and screwed (or otherwise inserted) into the pivot holes 116 of the base 110. The second pivot holes 142 should be slightly larger in diameter than the pivot screws 140 to allow for free azimuthal rotation of the azimuthal adjustment component 130 relative to the base 110. Although shown in the figures as having two pivot screws, it should be appreciated that the azimuthal adjustment component may have one pivot pin or screw which passes through both pivot holes 116 of the base 110. Also, the pivotal mount may comprise any of a number of different fastener types, including bolts, rods, pins, bearings or the like.

Figure 4:
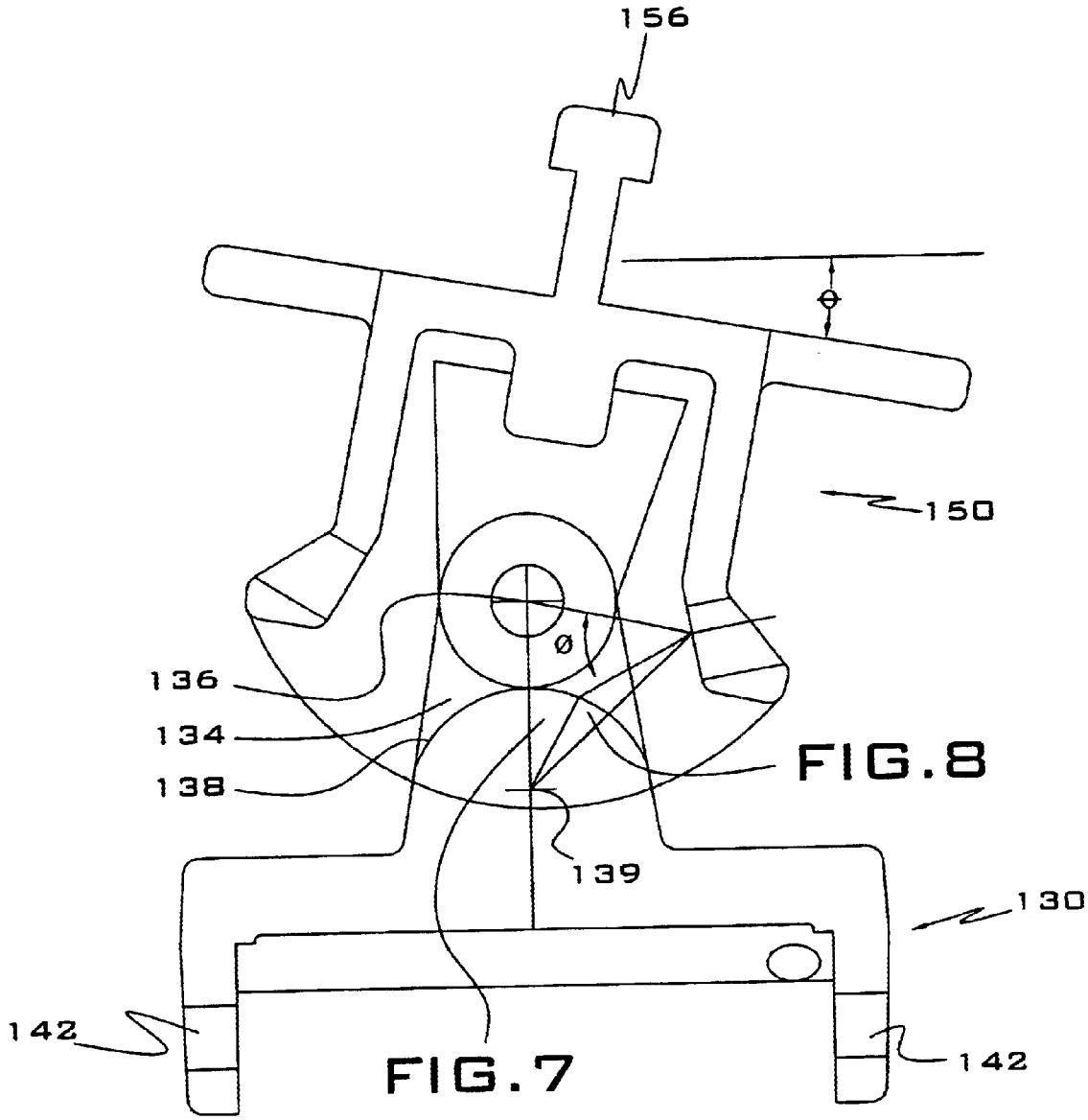
FIG. 4 is a pictorial representation of the azimuthal adjustment component and elevational adjustment component of the mounting assembly including the triangles from which the screw extension length can be determined.
Figure 5:
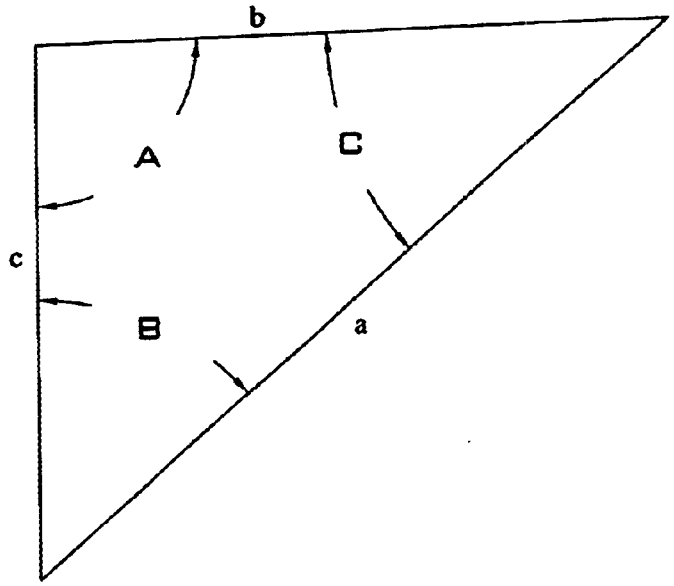
FIGS. 5 and 6 illustrate the trigonomic triangles shown in FIG. 3 used to determine the screw extension length as a function of the rotation angle.
Figure 6:
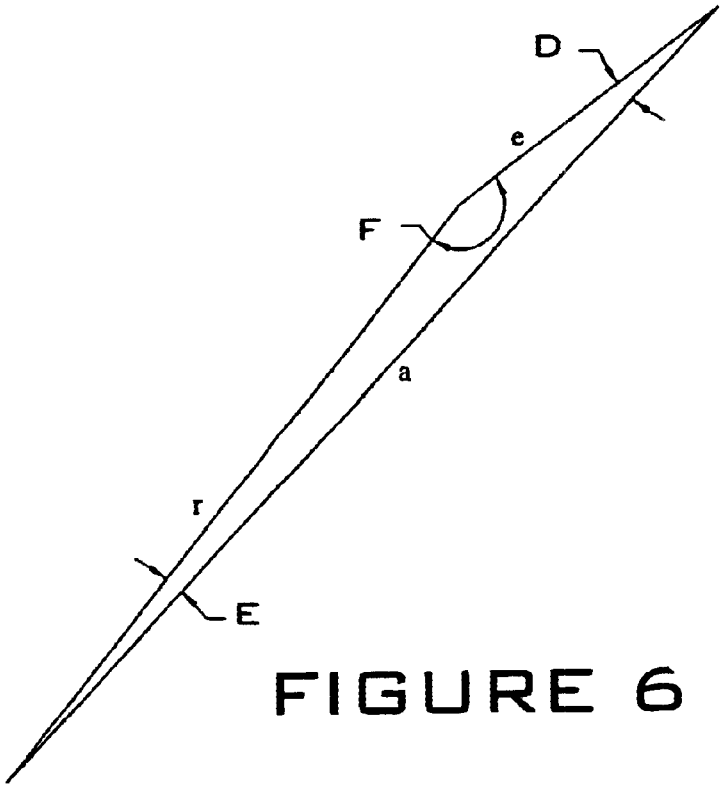
Figure 7:
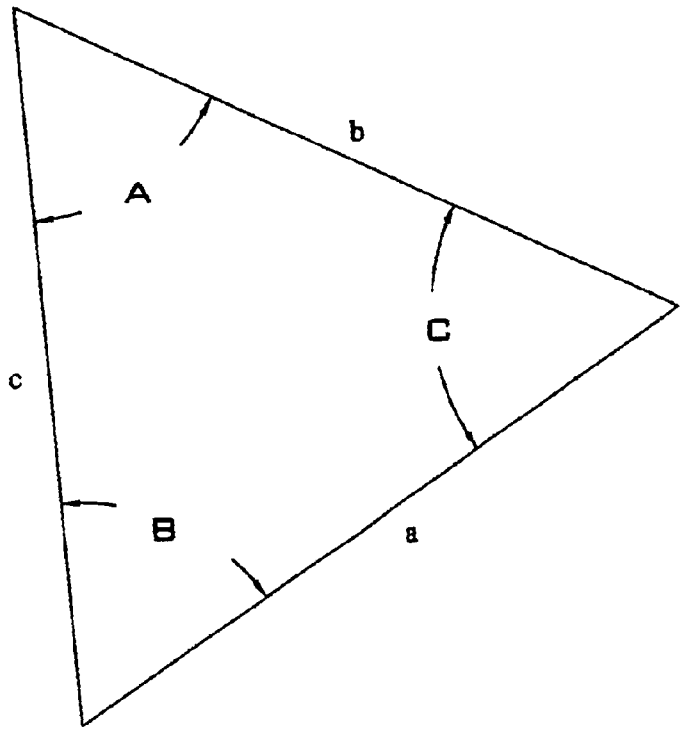
FIGS. 7 and 8 illustrate the trigonomic triangles shown in FIG. 4 used to determine the screw extension length as a function of the rotation angle.
Figure 8:
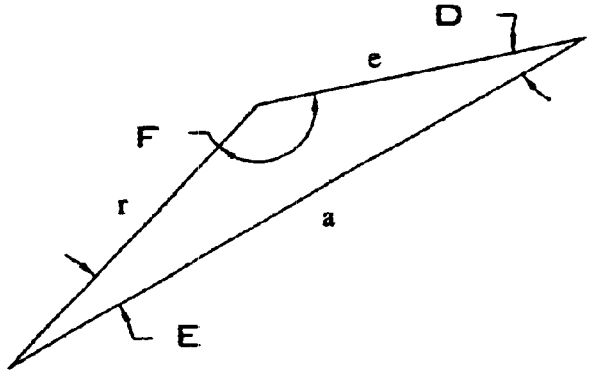

Adjustment component supports 134 and first pivot holes 136 allow for attachment of the elevational adjustment component 150. The contact plate 138 of the azimuthal adjustment component 130, shown in the figures as a semicircular protrusion between the adjustment component supports 134, has a center point 139 which is eccentrically located from the pivot axis in holes 136 of the adjustment component supports 134 (see FIG. 4). Although shown between adjustment component supports 134, the circular profile 138 may be located at alternative locations on the azimuthal adjustment component 130 including as an extension of one of the adjustment component supports 134 similar to the location of the circular profile 118 on the base 110. Further, although preferred embodiments of the contact plate 138 include a circular profile, other profiles may be substituted on the contact plate. For example, the contact plate may have an elliptical, paralobolic, hyperbolic or flat profiles. Also, a ridge or frame may be employed rather than a solid plate.

Adjustment screws 132 are inserted through adjustment holes 133 and interface with the circular profile of contact plate 118 on the base 110 when the azimuthal adjustment component 130 is in a locked position. The adjustment screws 132 allow for both azimuthal adjustment of the azimuthal adjustment component 130 and solid locking of the azimuthal adjustment component 130 into a desired location as is more fully described below. Preferably, the range of rotation for the azimuthal adjustment component 130 from vertical is at least +/−30°.

Although preferred adjustment members are screws 132, other types of adjustment members may be substituted. For example, any pin that is capable of being locked may be used. A pin may be locked using a set screw, a cotter pin, or the like.

Elevational adjustment component 150 comprises two adjustment members 152 (e.g., screws or pins), two adjustment holes 153, at least one pivot member 154 (e.g., screws or pins), pivot holes 155, a hanger element 156 and a plurality of mounting holes 158. The elevational adjustment component 150 is pivotally coupled to the azimuthal adjustment component 130 by the at least one pivot member 154. The pivot members 154 are inserted through the respective pivot holes 155 of the elevational adjustment component and screwed (or otherwise inserted) into the pivot holes 136 of the azimuthal adjustment component 130. The pivot holes 136 should be slightly larger in diameter than the pivot screws 154 to allow for free elevational rotation of the elevational adjustment component 150 relative to the azimuthal adjustment component 130. Although shown in the figures as having two pivot members (shown as screws), it should be appreciated that the elevational adjustment component may have one pivot member which goes through both of the first pivot holes 136 of the azimuthal adjustment component 130. Also, the pivot mechanism may comprise any of a number of different fastener types, including bolts, rods, pins, bearings or the like.

Adjustment members 152 are inserted through adjustment holes 153 and interface with a contact plate 138 preferably having a circular profile on the azimuthal adjustment component 130 when the elevational adjustment component 150 is in a locked position. The adjustment members 152 allow for both elevational adjustment of the elevational adjustment component 150 and solid locking of the elevational adjustment component 150 into a desired location as is more fully described below. Preferably, the range of rotation for the elevational adjustment component from horizontal is at least +/−30 degrees.

Mounting holes 158 allow for attachment of a radio 170 or antenna 180 to the elevational adjustment component 150. Hanging member 156 (shown as a shoulder screw) provides a hanger for loose attachment of the radio as will be described more fully below.

According to another embodiment of the invention, a method is disclosed for mounting the mounting assembly and radio 170 (or antenna 180) on a pole mount or other support structure and aligning and locking the radio/antenna into a desired azimuth and elevation position. Although the description below refers to a radio, the same steps can be performed with an antenna. In a preferred embodiment, the base 110 of the mounting assembly 100 is mounted to a support structure (shown as a pole 10 in FIG. 1) via mounting holes 120. Subsequent to mounting the base 110 to the support structure, the radio 130 is loosely hung on the shoulder screw 156. The head of the screw 156 can be inserted into the casting of the radio 180, which has a slot to receive the head of the screw. The shoulder screw 156 is a convenience mechanism for an installer, allowing the installer to free up a hand for carrying screws and washers, thereby facilitating mounting of the radio 180. Once the radio 180 is hung on the shoulder screw, the installer can tightly mount the radio 180 to the elevational adjustment component 150 via the mounting holes 159 and fasteners (not shown).

Once the radio 180 has been firmly mounted, a voltmeter is connected to the radio 180 to obtain power measurements, which ensure proper alignment or positioning of the azimuthal and elevational adjustment components. Once the correct power reading is obtained on the voltmeter, the adjustment components 130 and 150 can be locked into position. (The correct power reading may be either a specific power reading desired by the technician or a power reading evidencing the optimum signal.) The azimuthal and elevational adjustment components 130 and 150 are adjusted by tightening and/or loosening their respective adjustment screws. Referring to FIGS. 3–8, to solidly lock the adjustment components, 130 and 150 both adjustment screws 132 and 152 on a respective component interface with the respective contact plate 118, 138 on the base 110 and the azimuthal adjustment component 130. Having a circular profile or other geometry with a center eccentrically located to the pivot axes of the adjustment components provides for a solid locking geometry. As noted above, contact plates having other profiles with focal points for contact by the adjustment screws may be used as well. To adjust the positioning of the adjustment components, 130, 150 one adjustment screw on each component is extended and one adjustment screw is withdrawn. By having two screws, one on each side of the adjustment component 130, 150, the adjustment component cannot move without adjusting the screws. This provides a solid locking between the all three of the main components 110, 130, 150 of the mounting assembly 100.

As is apparent from FIGS. 3–8, in order to vary the angle of rotation, the length of the adjustment screws, for both the azimuthal and elevational adjustment components, from the adjustment component 130, 150 to the respective contact plate 118, 138 to which the screws interface is changed. Referring to FIGS. 3–8, using geometry and trigonometry principles, screw length e can be determined as a function of the angle of rotation θ as described by the following equations:

Constants b=length between center point of axis of rotation and screw extensions end point on rotating component.

c=length between center point of axis of rotation and center of circular profile of contact plate.

τ=radius of circular profile of contact plate.

ϕ=angle between b and e, the screw extension length.

$A_i$=angle between b and c when θ (rotation angle)=0.

(Upper case=angles, lower case=lengths)

Triangle 1:

At θ=0, from geometry, $A_i$ can be calculated. Then A as a function of rotation angle θ can be defined as:

$$A(\theta)=A_i-\theta$$

(Note: from here on, A (θ) will be referred to as A).

From the law of cosines, $$a=\sqrt{b^2+c^2-2bc\cos(A)}$$

Substitute for A to find a as a function of θ:

$$a=\sqrt{b^2+c^2-2bc\cos(Ai-\theta)}$$

Similarly, to find angle C:

$$C=\sin^{-1}\left(\frac{c\sin(A)}{a}\right)$$

$$=\sin^{-1}\left(\frac{c\sin(Ai-\theta)}{\sqrt{b^2+c^2-2bc\cos(Ai-\theta)}}\right)$$

Triangle 2:

Angle D can be calculated as follows:

$$D=C-\phi$$

Substituting for C:

$$D=\sin^{-1}\left(\frac{c\sin(Ai-\theta)}{\sqrt{b^2+c^2-2bc\cos(Ai-\theta)}}\right)-\phi$$

Similarly, F can be solved:

$$F=\sin^{-1}\left(\frac{a\sin D}{\tau}\right)$$

$$=\sin^{-1}\left[\frac{\sqrt{b^2+c^2-2bc\cos(Ai-\theta)}\cdot\sin\left(\sin^{-1}\left(\frac{c\sin(Ai-\theta)}{\sqrt{b^2+c^2-2bc\cos(Ai-\theta)}}\right)-\phi\right)}{\tau}\right]$$

Next, solving for E:

$$E=180-D-F$$

Substituting:

$$E=180-\sin^{-1}\left(\frac{c\sin(Ai-\theta)}{\sqrt{b^2+c^2-2bc\cos(Ai-\theta)}}\right)+$$

-continued $$\phi-\sin^{-1}\left[\frac{\sqrt{b^2+c^2-2bc\cos(Ai-\theta)}\cdot\sin\left(\sin^{-1}\left(\frac{c\sin(Ai-\theta)}{\sqrt{b^2+c^2-2bc\cos(Ai-\theta)}}\right)-\phi\right)}{\tau}\right]$$

And e can found using sin law $$e=\frac{r\sin(E)}{\sin(D)}$$

substituting for E and D gives e as a function of θ:

$$e=\frac{\tau\cdot\sin\left[180-\sin^{-1}\left(\frac{c\sin(Ai-\theta)}{\sqrt{b^2+c^2-2bc\cos(Ai-\theta)}}\right)+\phi-\sin^{-1}\left\{\frac{\sqrt{b^2+c^2-2bc\cos(Ai-\theta)}\cdot\sin\left(\sin^{-1}\left(\frac{c\sin(Ai-\theta)}{\sqrt{b^2+c^2-2bc\cos(Ai-\theta)}}\right)-\phi\right)}{\tau}\right\}\right]}{\sin\left[\sin^{-1}\left(\frac{c\sin(Ai-\theta)}{b^2+c^2-2bc\cos(Ai-\theta)}\right)-\phi\right]}$$

This geometry, wherein adjustment screws on an azimuthal or elevational adjustment member interface with a contact plate having a center point which is eccentrically located from the pivot axis on which the adjustment member rotates, provides advantages including a solid locking mechanism, a relatively short lever arm for a more compact and stronger structure, and two independently adjustable pivot axes for easier and more efficient alignment.

While preferred embodiments of the present invention have been described, it is to be understood that the embodiments described are illustrative only and the scope of the invention is to be defined solely by the appended claims when accorded a full range of equivalents, many variations and modifications naturally occurring to those of skill in the art from a perusal thereof. For example, although the mounting assembly has been shown and described as an apparatus for mounting and adjusting a radio/antenna, the mounting assembly of the present invention may be used for mounting various equipment that may require azimuthal or elevational adjustment.

What is claimed is:

1. A mounting assembly for mounting a radio or antenna comprising:

a base capable of mounting to a surface having a first curved contact member having a center, an azimuthal adjustment component pivotally mounted to the base for pivoting about an azimuthal pivot axis offset from the center of the first curved contact member and having at least two first adjustment members and a second curved contact member, and an elevational adjustment component pivotally mounted to the azimuthal adjustment component for pivoting about an elevational pivot axis offset from the center of the second curved contact member and having at least two second adjustment members, wherein the azimuthal and elevational adjustment components are adjustable by advancing or retracting the respective first and second adjustment members.

2. The assembly of claim 1 wherein the elevational adjustment component further comprises a hanger on which a radio or antenna can be mounted.

3. The assembly of claim 1 further including a radio.

4. The assembly of claim 1 further including an antenna.

5. The assembly of claim 1 wherein the first and second curved contact member is a plate having a semi-circular portion.

6. A mounting assembly comprising:

a base having a contact member, and a first adjustment component pivotally mounted to the base for pivoting about a first adjustment component pivot axis and having at least two adjustment members located on opposite sides of the pivot axis which contact the contact member when the first adjustment component is in a locked position.

7. The mounting assembly of claim 6 wherein the first adjustment component includes a contact member, and wherein the mounting assembly further comprises:

a second adjustment component pivotally mounted to the first adjustment component for pivoting about a second adjustment component pivot axis and having two adjustment members located on opposite sides of the second adjustment pivot axis which contact the contact member of the first adjustment component when the second adjustment component is in a locked position.

8. The mounting assembly of claim 7, wherein the contact member of the base has a center or focal point which is offset from the first adjustment component pivot axis and the contact member of the first adjustment component has a center or focal point which is offset from the second adjustment component pivot axis.

9. The mounting assembly of claim 7 wherein one of the first or second adjustment components is adjustable in azimuth and the other of the first or second adjustment components is adjustable in elevation.

10. The mounting assembly of claim 7 wherein the first adjustment component is adjustable in azimuth and the second adjustment component is adjustable in elevation.

11. The mounting assembly of claim 7 wherein the contact member of the base and the first adjustment component is a curved plate.

12. The mounting assembly of claim 7 wherein the second adjustment component further includes a hanging member for hanging a radio or antenna to be mounted.

13. The mounting assembly of claim 12 wherein the hanging member is a shoulder screw.

14. The assembly of claim 7 wherein the base has a plurality of mounting holes for attachment to a support.

15. The assembly of claim 7 wherein the second adjustment component further includes means for mounting a radio or antenna.

16. The assembly of claim 7 further comprising a radio attached to the second adjustment component.

17. The assembly of claim 7 further comprising an antenna attached to the second adjustment component.

18. The assembly of claim 7 wherein the first and second adjustment components are adjustable by advancing or retracting the respective adjustment members.

19. The assembly of claim 18 wherein the adjustment members are screws.

20. A method of adjusting a mounting apparatus comprising:

a) pivoting an adjustment component having adjustment members about a pivot axis; and b) locking the adjustment component in a desired position by advancing at least one adjustment member and retracting at least one adjustment member that contact a contact member on a base to which the adjustment component is pivotally mounted.

21. The method of claim 20 wherein the adjustment members are two screws that are advanced towards and retracted from respective portions of the contact member to pivot the adjustment component.

22. The method of claim 21 wherein the contact member of the base is a plate having a portion with a curved profile which the screws engage when the adjustment component is locked.

23. The method of claim 22 wherein the plate has a center or focal point which is offset from a pivot axis of the adjustment component.

24. The method of claim 20, wherein the adjustment component is a first adjustment component having a contact member, and further comprising:

pivoting a second adjustment component having adjustment members about a pivot axis; and locking the second adjustment component in a desired position by advancing at least one adjustment member of the second adjustment component and retracting at least one adjustment member of the second adjustment component that contact the contact member on the first adjustment component to which the second adjustment component is pivotally mounted.

25. The method of claim 24 wherein the first adjustment component is adjustable in azimuth and the second adjustment component is adjustable in elevation.

26. The method of claim 24 further comprising attaching a radio or antenna to the second adjustment component before adjusting the first and second adjustment components.

27. The method of claim 26 wherein the step of attaching a radio or antenna to the second adjustment component comprises:

hanging the radio or antenna on a hanging member attached to the second adjustment component, and firmly mounting the radio or antenna to the second adjustment component.

28. The method of claim 27, wherein the hanging member is a shoulder screw.

29. The method of claim 20 wherein step a) comprises:

i) measuring a magnitude of a signal received by a radio or antenna attached to the adjustment component, ii) pivoting the adjustment component, iii) repeating steps i) and ii) until a desired reading is obtained, and iv) locking the pivoted adjustment component in position by advancing or retracting the adjustment members of the pivoted adjustment component.

30. The method of claim 29 wherein the magnitude of a signal is measured using a voltmeter.

31. The method of claim 20 wherein the adjustment members of the first and second adjustment components are advanced or retracted a distance which is calculated as a function of an angle of rotation of the respective first and second adjustment components.

* * * * *